US007121240B2

(12) United States Patent
Tani

(10) Patent No.: US 7,121,240 B2
(45) Date of Patent: Oct. 17, 2006

(54) VALVE CONTROLLER

(75) Inventor: Hideji Tani, Hashima-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/957,592

(22) Filed: Oct. 5, 2004

(65) Prior Publication Data

US 2005/0076867 A1 Apr. 14, 2005

(30) Foreign Application Priority Data

Oct. 9, 2003 (JP) ..... 2003-350861
Apr. 23, 2004 (JP) ..... 2004-128255

(51) Int. Cl.
*F01L 1/34* (2006.01)

(52) U.S. Cl. ..... 123/90.17; 123/90.15; 123/90.11; 123/321; 123/90.18; 251/129.11; 251/264; 251/249.5; 701/101; 701/105

(58) Field of Classification Search ..... 123/90.17
See application file for complete search history.

(56) References Cited

U.S. PATENT DOCUMENTS 5,150,916 A * 9/1992 Petrofes et al. ..... 188/266.4
5,417,187 A * 5/1995 Meyer et al. ..... 123/90.17
5,562,071 A * 10/1996 Urushihata et al. ..... 123/90.15
5,680,834 A * 10/1997 Szpak et al. ..... 123/90.15
5,886,504 A * 3/1999 Scott et al. ..... 322/15
6,012,437 A * 1/2000 Radhamohan et al. . 123/568.23
6,129,061 A * 10/2000 Okuda et al. ..... 123/90.17
6,371,066 B1 * 4/2002 Cullen ..... 123/90.15
6,795,291 B1 * 9/2004 Miller ..... 361/154

FOREIGN PATENT DOCUMENTS

JP U-4-105906 9/1992
JP 5-308794 11/1993
JP 11-324625 11/1999

* cited by examiner

*Primary Examiner*—Thai-Ba Trieu
*Assistant Examiner*—Kyle M. Riddle
(74) *Attorney, Agent, or Firm*—Nixon & Vanderhye P.C.

(57) ABSTRACT

The valve controller is driven by a motor. The valve controller has a control circuit and a driving circuit. The driving circuit drives a motor based on a control signal generated by the control circuit and a rotational position signal generated by a rotational position sensor. The driving circuit generates a rotation number signal representing an actual rotation number of the motor according to the rotational position signal, and transfers the rotation number signal to the control circuit.

16 Claims, 12 Drawing Sheets

VALVE CONTROLLER

CROSS REFERENCE TO RELATED APPLICATION

This application is based on Japanese Patent Applications No. 2003-350861 filed on Oct. 9, 2003 and No. 2004-128255 filed on Apr. 23, 2004, the disclosures of which are incorporated herein by reference.

FIELD OF THE INVENTION

The present invention relates to a valve controller for an internal combustion engine, which is driven by an electric motor. The valve controller changes valve timing or valve lift of an intake valve and/or an exhaust valve of the internal combustion engine.

BACKGROUND OF THE INVENTION

As shown in JP-U-4-105906A, the valve controller changes valve timing of an intake valve and/or an exhaust valve by rotational torque of an electric motor. Alternatively, the valve controller changes valve lift of an intake valve and/or an exhaust valve by rotational torque of an electric motor as shown in JP-11-324625A.

In such a valve controller, an electric current supplied from a driving circuit to the motor is controlled by a control circuit. A control signal is generated in the control circuit according to a rotation number signal detected by a rotation sensor which detects an actual rotation number of the motor. A rotational position signal of the motor is detected by a rotational position sensor. The operation of the motor is controlled based on the control signal and the rotational position signal.

The conventional valve controller driven by the electric motor needs the rotation number sensor and the rotational position sensor independently. Thus, the size of the valve controller becomes large and the production cost increases.

SUMMARY OF THE INVENTION

An object of the present invention is to provide a valve controller which is compact and of which production cost is reduced. According to the present invention, a valve controller adjusts a valve characteristic utilizing a rotational torque of a motor. The valve controller includes a control circuit, a rotational position sensor and a driving circuit. The control circuit generates a control signal. The rotational position sensor detects a rotational position of the motor, and generates a rotational position signal. The driving circuit drives the motor based on the control signal and the rotational position signal, generates a rotation number signal which represents an actual rotation number of the motor based on the rotational position signal, and transmits the rotation number signal to the control circuit.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

An embodiment of the present invention will be described hereinafter with reference to the drawings.

(First Embodiment)

Figure 2:
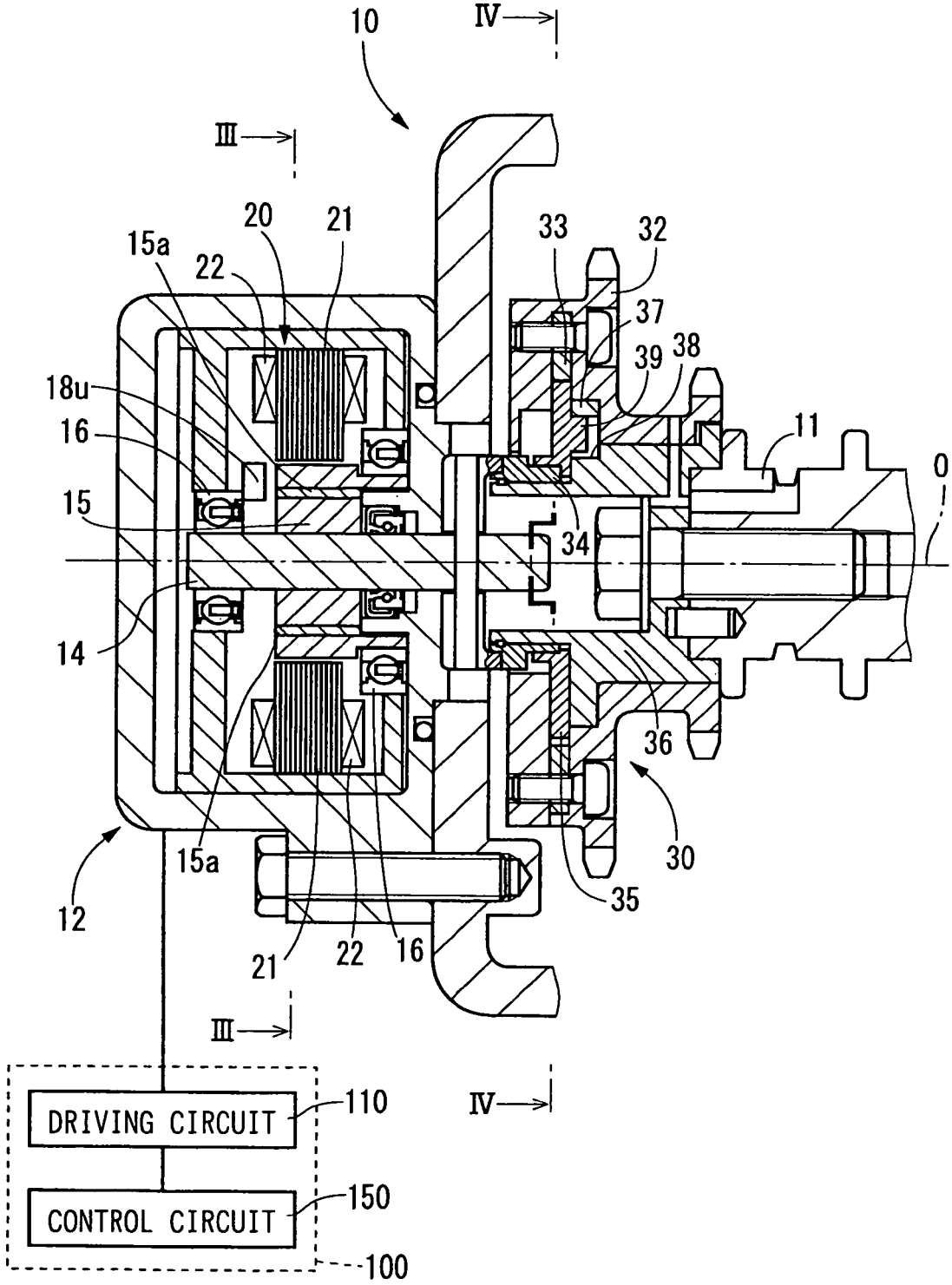
FIG. 2 is a cross-sectional view of the valve timing controller according to the first embodiment.
Figure 3:
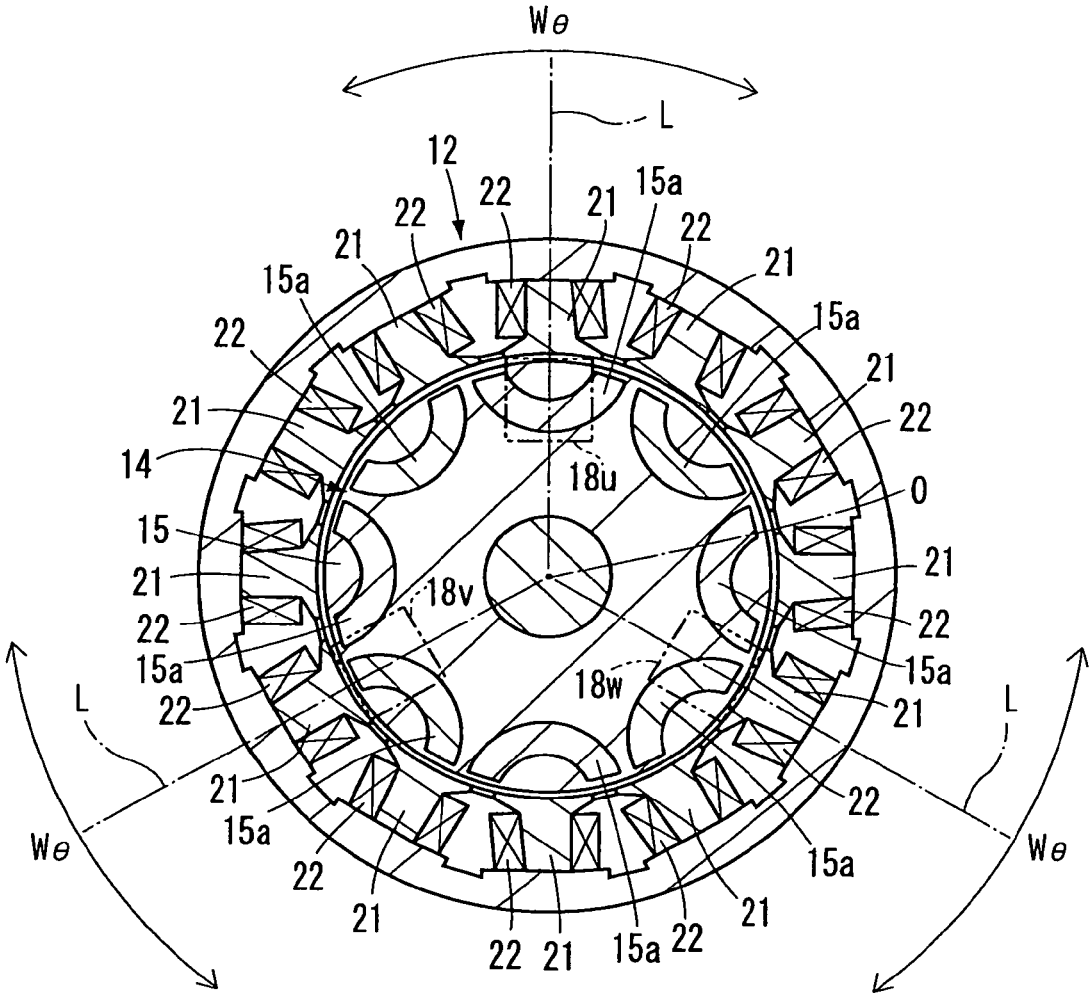
FIG. 3 is a cross-sectional view along the line III—III in FIG.2.
Figure 4:
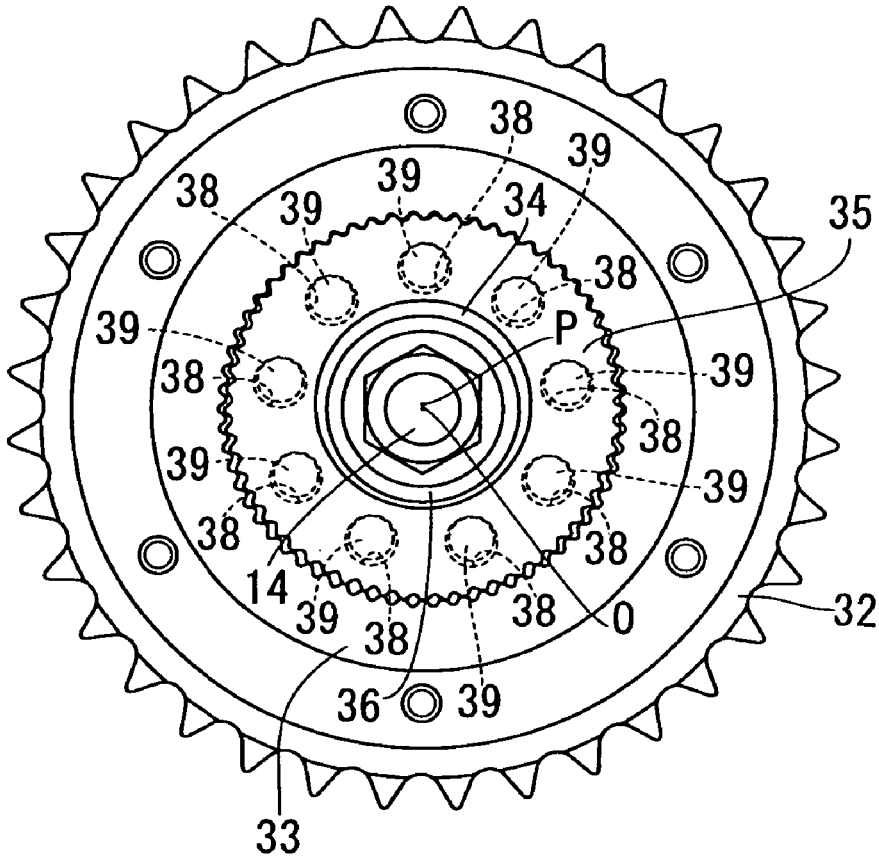
FIG. 4 is a cross-sectional view along the line IV—IV in FIG. 2.

Referring to FIGS. 2 to 4, a first embodiment is described hereinafter. The valve timing controller 10 is disposed in a torque transfer system from a crankshaft to a camshaft 11. The valve timing controller 10, which is referred to as VTC 10 hereinafter, changes valve timing of the intake valve and the exhaust valve by utilizing a rotational torque of an electric motor 12 which is controlled by a motor control device 100.

The electric motor 12 is a three-phase brushless motor having a motor shaft 14, a bearing 16, Hall effect devices 18*u*, 18*v*, 18*w* as rotational positioning sensors, and a stator 20.

The motor shaft 14 is supported by a pair of bearings 16 and rotates clockwise/ counterclockwise around an axis "O". In FIG. 3, when the motor shaft 14 rotates clockwise, it is called that the motor shaft 14 rotates in normal direction. When the motor shaft 14 rotates counterclockwise, it is called that the motor shaft 14 rotates in reverse direction. A rotor 15 is provided on the motor shaft 14 and has eight magnets 15*a* therein. Each of the magnets 15*a* is disposed around the axis "O" at regular intervals, and has a different magnetic pole between adjacent magnets 15*a*, which is generated on the outer surface of the rotor 15. The three Hall effect devices 18*u*, 18*v*, 18*w* are disposed around the axis "O" at regular intervals in the vicinity of the rotor 15.

Figure 5:
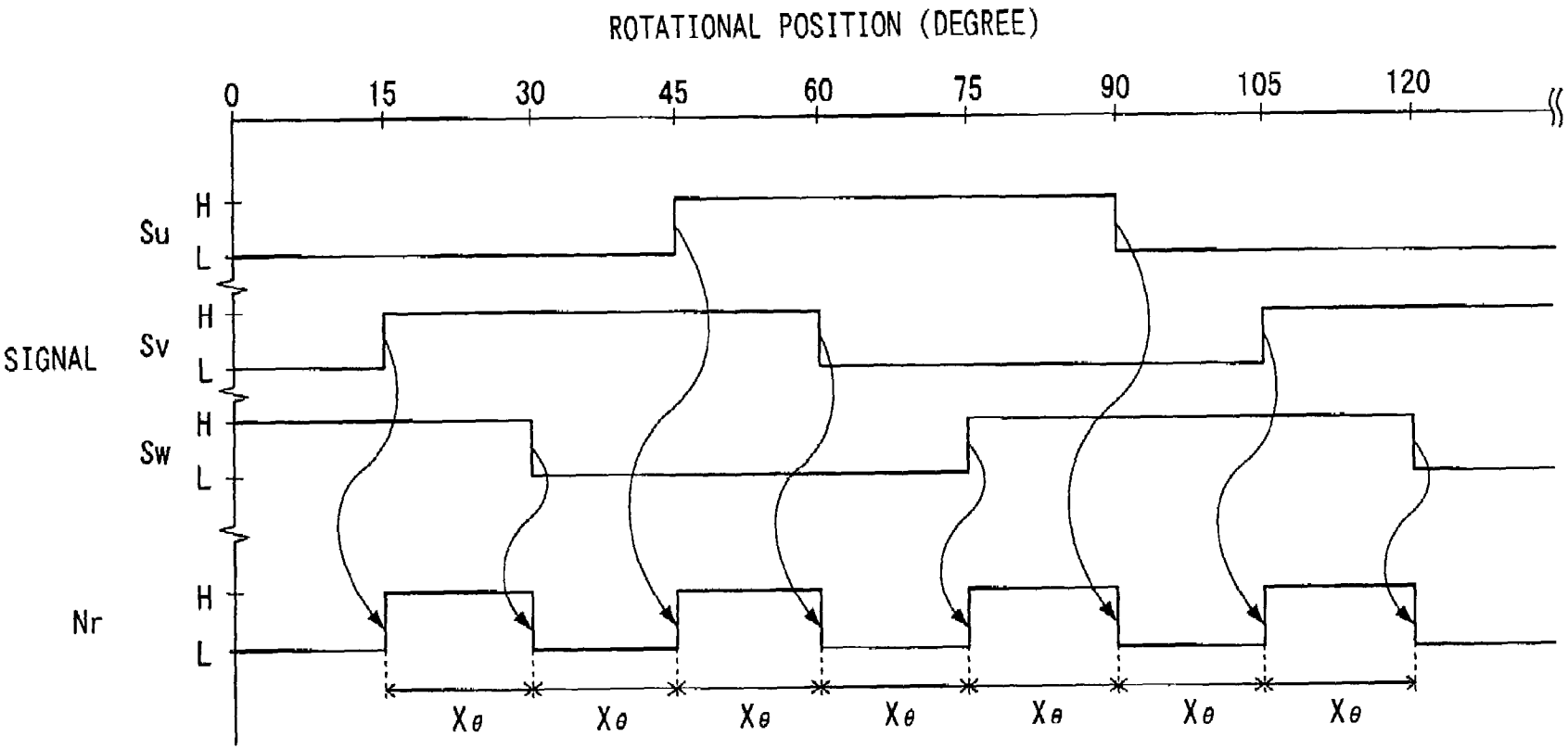
FIG. 5 is a time chart for explaining the operation of the motor control device according to the first embodiment.

FIG. 5 shows signals detected by the Hall effect devices 18*u*, 18*v*, 18*w*, which are denoted by "Su", "Sv", "Sw". When the North Pole magnet 15*a* is located in angle range $W_\theta$ of ±22.5° relative to a radial line L crossing each of the Hall effect devices 18*u*, 18*v*, 18*w*, each of the Hall effect devices 18*u*, 18*v*, 18*w* generates a high voltage signal which is denoted by "H". On the other hand, when the South Pole magnet 15*a* is located in the angle range $W_\theta$, each of the Hall effect devices 18*u*, 18*v*, 18*w* generates a low voltage signal which is denoted by "L". The signals detected by the Hall effect devices 18*u*, 18*v*, 18*w* are changed between "H" and "L" according to a rotational position θ of the motor shaft 14.

Figure 6:
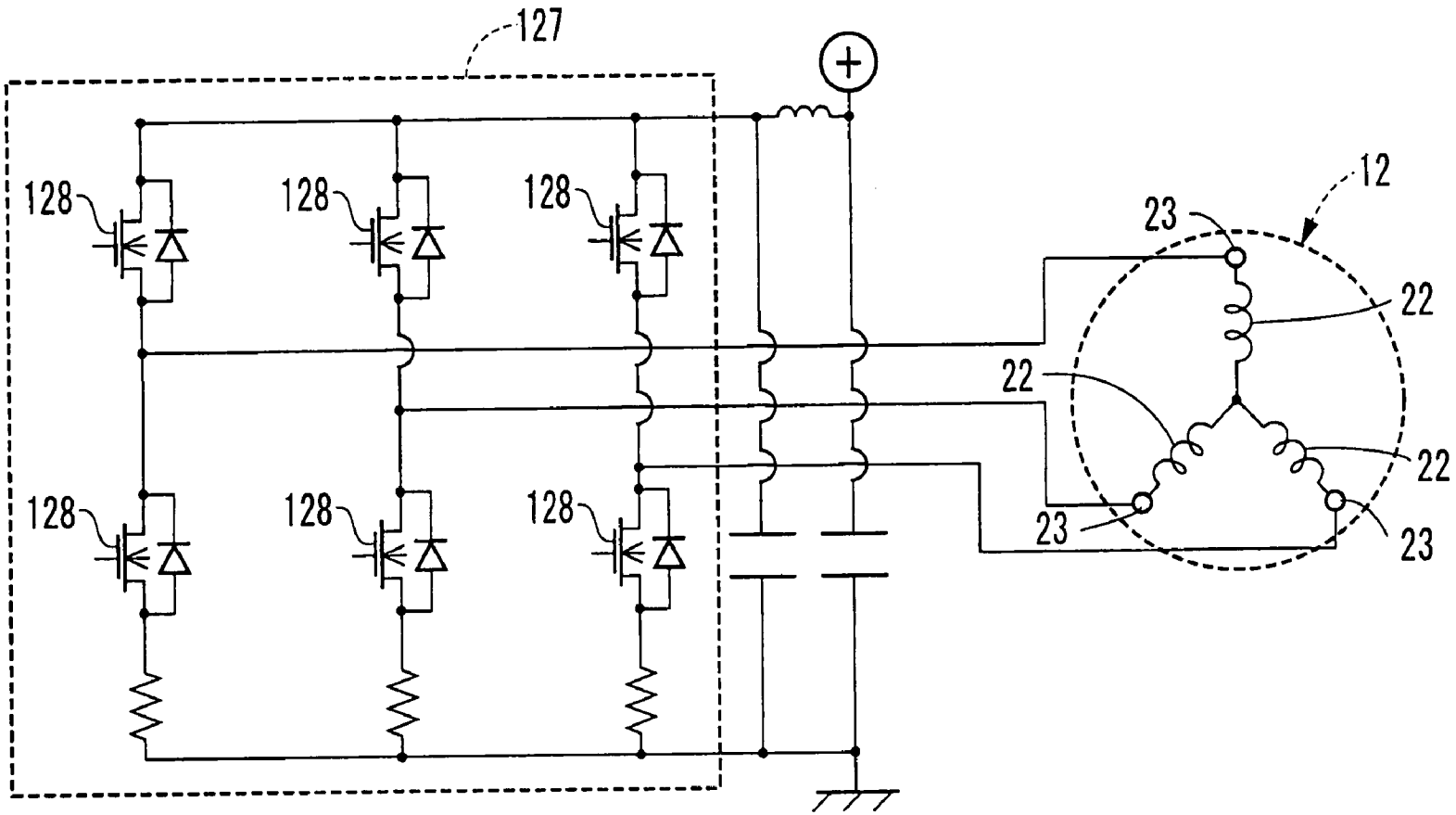
FIG. 6 is a schematic circuit diagram of the current supplying part according to the first embodiment.

The stator 20 is disposed around the motor shaft 14. The stator 20 has twelve cores 21 which are disposed at regular intervals around the axis "O" and on each of which a coil 22 is wound. The coils 22 are connected in the star connection at one end as shown in FIG. 6 and are connected to a drive circuit 110 of the motor control device 100 at the other end 23. The energized coil 22 generates a rotational magnetic field around the motor shaft 14 clockwise or counterclockwise. When the clockwise magnetic field is generated in FIG.3, the magnets 15*a* receive the interaction so that the rotational torque in the normal direction is applied to the motor shaft 14. Similarly, when the counterclockwise magnetic field is generated, the rotational torque in the reverse direction is applied to the motor shaft 14.

A phase changing mechanism 30 of VTC 10, as shown in FIGS. 2 and 4, has a sprocket 32, a ring gear 33, an eccentric shaft 34, a planetary gear 35, and an output shaft 36.

The sprocket 32 is provided on the same axis of the output shaft 36, and rotates around the axis "O" in the same direction as the motor shaft 14. The sprocket 32 rotates around clockwise in FIG. 4 while maintaining the rotational phase relative to the crankshaft. The ring gear 33 is an internal gear, and is coaxially fixed on the inside of the sprocket 32 to rotate together.

The eccentric shaft 34 is directly connected to the motor shaft 14 to rotate together. The planetary gear 35 is an external gear, and is disposed in the inside of the ring gear 33 while engaging the teeth thereof with the teeth of the ring gear 33. The planetary gear 35 is coaxially supported by the eccentric shaft 34 and rotates around an eccentric axis "P". The output shaft 36 is coaxially connected to the camshaft 11 by a bolt to rotate around the axis "o" with the camshaft 11. The output shaft 36 has an engaging plate 37 which is a disk-shaped plate having the center axis "o". The engaging plate 37 has nine engaging holes 38 which are formed at regular intervals around the axis "O". The planetary gear 35 has nine engaging projections 39 around the eccentric axis "p" which are engaged with the engaging holes 38 individually.

When the motor shaft 14 does not rotate relative to the sprocket 32, the planetary gear 35 rotates clockwise with the sprocket 32 while maintaining the engaging position with the ring gear 33. Because the engaging projections 39 urge the inner surface of the engaging holes 38, the output shaft 36 rotates clockwise without relative rotation to the sprocket 32 by which a rotational phase of the camshaft 11 relative to the crankshaft is maintained.

When the motor shaft 14 rotates counterclockwise relative to the sprocket 32, the planetary gear 35 rotates clockwise relative to the eccentric shaft 34 to change engaging position with the ring gear 33. At this moment, the urging force by which the engaging projections 39 urge the inner surface of the engaging holes 38 increases, so that the rotational phase of the output shaft 36 is advanced relative to the sprocket 32. That is, the rotational phase of the camshaft 11 relative to the crankshaft is advanced.

When the motor shaft 14 rotates clockwise relative to the sprocket 32, the planetary gear 35 rotates counterclockwise relative to the eccentric shaft 34 to change engaging position with the ring gear 33. At this moment, the urging force by which the engaging projections 39 counterclockwise urge the inner surface of the engaging holes 38 increases, so that the rotational phase of the output shaft 36 is retarded relative to the sprocket 32. That is, the rotational phase of the camshaft 11 relative to the crankshaft is retarded.

As shown in FIG. 2, the motor control device 100 has the driving circuit 110 and the control circuit 150. Both of the circuits 110 150 are schematically illustrated at the outside of the motor 12. However, each of the circuits 110, 150 can be disposed at the inside or the outside of the motor 12.

The control circuit 150 controls the electric current which is supplied from the driving circuit 110 to the motor 12, and also controls an igniter and a fuel injection device of the engine. The control circuit 150 includes a microcomputer, which determines a target rotation number Ra of the motor shaft 14 and a target rotational direction Da of the motor shaft 14. The target rotation number Ra is an absolute number.

Figure 1:
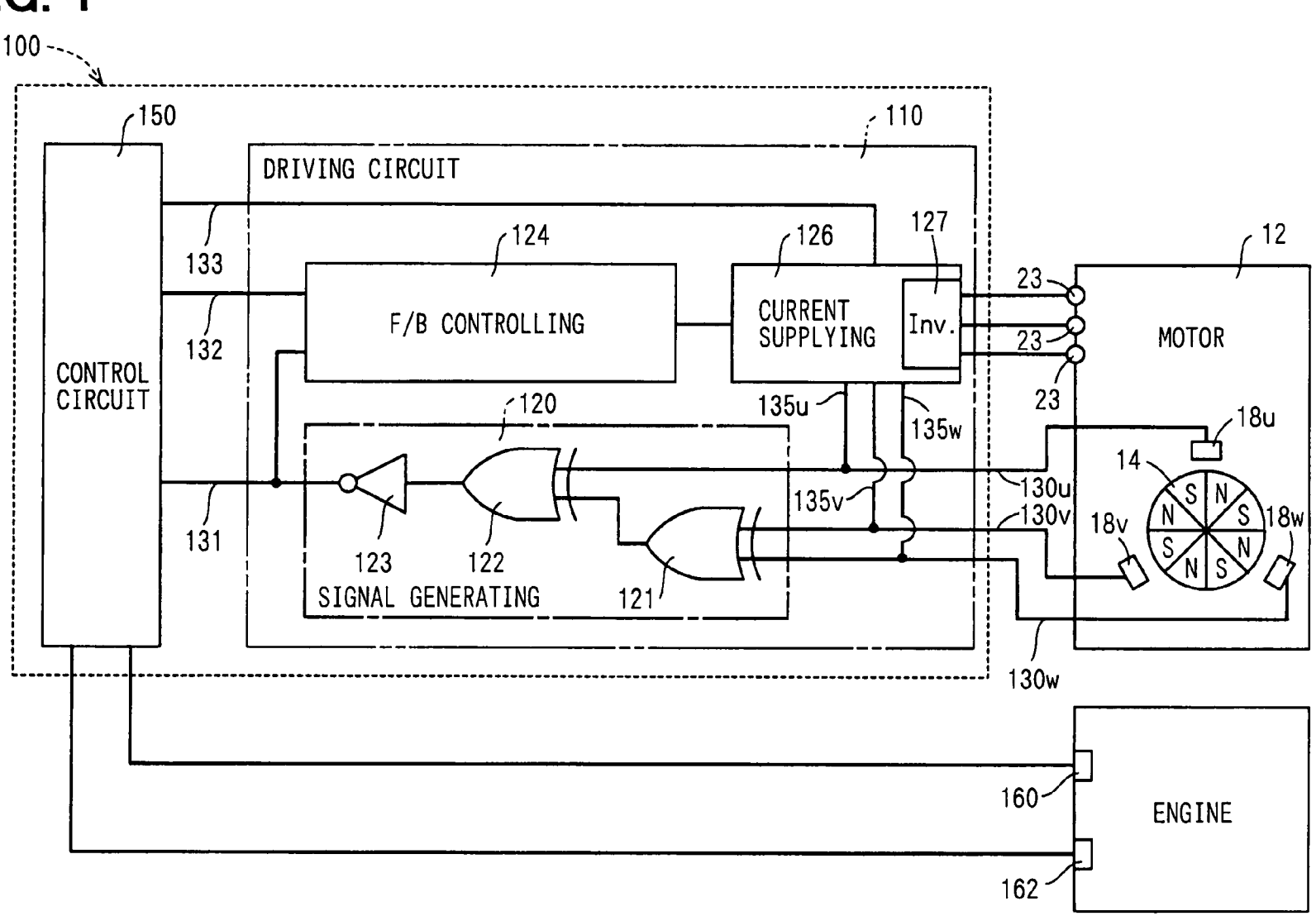
FIG. 1 is a block diagram showing a motor control device according to a first embodiment of the present invention.

As shown in FIG. 1, the control circuit 150 is connected to the driving circuit 110, a rotation number sensor 160 which detects the rotation number of the crankshaft, and a rotation number sensor 162 which detects the rotation number of the camshaft 11. The control circuit 150 determines target rotation number Ra and the target rotational direction Da based on the rotation number signal Nr which is generated in the driving circuit 110, and based on the detected signals from the rotation number sensor 160, 162. In order to determine the target rotation number Ra, the rotation number of the motor shaft 14 to maintain or change the rotational phase is derived based on the actual rotation number R of the motor shaft 14. The rotation numbers and the rotational signals of the crankshaft and the camshaft 11 represent the actual rotation number R. And then the derived rotation number is replaced by the target rotation number Ra. The control circuit 150 generates a first control signal and a second control signal. The first control signal is obtained by converting the target rotation number Ra into a voltage signal, and the second control signal is obtained by converting the target rotational direction Da into a voltage signal.

The driving circuit 110 supplies the electric current to and controls the motor 12. The driving circuit 110 includes a signal generating part 120, a feedback controlling part 124, and a current supplying part 126.

The signal generating part 120 is connected to the Hall effect devices 18*u*, 18*v*, 18*w* through three leads 130*u*, 130*v*, 130*w*, and is connected to the control circuit 150 through a lead 131. The signal generating part 120 generates the rotation number signal Nr representing the actual rotation number R and transmits the rotation number signal Nr to the control circuit 150. The actual rotation number R is an absolute number of the rotation number of the motor shaft 14.

The signal generating part 120 includes a first XOR gate 121, a second XOR gate 122 and an inverter gate 123. The first XOR gate 121 receives the signals from the Hall effect devices 18*v*, 18*w*, the second XOR gate 122 receives the signal from the Hall element 18*u* and output signal from the first XOR gate, and the inverter gate 123 receives the output signal from the second XOR gate. As shown in FIG. 5, the output signal from the inverter gate 123 is turned out between the high voltage signal denoted by "H" and the low voltage signal denoted by "L" whenever an edge is generated in the detected signals Su, Sv, Sw. While the output signal is maintained at the regular voltage, the motor shaft 14 rotates an angle range $X_\theta$ which corresponds to about one third of the angle range $W_\theta$. Thus, the actual rotation number R of the motor shaft 14 is derived from a time difference between adjacent edges. That is, output signal represents the real rotation number R of the motor shaft 14 indirectly, and the signal generating part 120 generates the output signal as the rotation number signal.

The signal generating part 120 can be replaced by a microcomputer.

The feedback controlling part 124 receives the first control signal through a lead 132, the first control signal being generated by the control circuit 150. The feedback controlling part 124 determines the voltage Vs which is applied to the motor 12 according to the first control signal representing the target rotation number Ra. In the present embodiment, the feedback controlling part 124 is connected with the signal generating part 120 and derives the actual rotation number R of the motor shaft 14 according to the rotation number signal Nr generated by the signal generating part 120. The feedback controlling part 124 determines the voltage Vs in such a manner that the actual rotation number R coincides with the target rotation number Ra represented by the first control signal. The feedback controlling part 124 generates a command signal that the current supplying part 126 generates the voltage Vs.

The current supplying part 126 is connected with the feedback controlling part 124, the control circuit 150 through a lead 133 for receiving a second control signal, and terminals 23 of the motor 12. The current supplying part 126 applies the voltage Vs to the motor 12 in such a manner that the target rotation direction Da represented by the second control signal is realized. The current supplying part 126 is connected to leads 135*u*, 135*v*, 135*w*, each of which is individually branched from the leads 130*u*, 130*v*, 130*w*. The current supplying part 126 includes an inverter circuit 127 which is a bridge circuit, and determines a switching pattern of switching elements 128 according to the detected signal by the Hall effect devices 18*u*, 18*v*, 18*w*, the command signal from the feedback controlling part 124, and the second controlling signal representing the target rotation direction Da. The current supplying part 128 applies the voltage to the wire 128 which is located between two of the energized switching elements 128 according to the switching pattern.

The operation of the motor control device 100 is described hereinafter.

When all of the Hall effect devices 18*u*, 18*v*, 18*w* operate normally, the voltage of the rotation number signal Nr generated by the signal generating part 120 is turned over between high voltage "H" and low voltage "L" as shown in FIG. 5 whenever the edge of the detected signal arise at the regular intervals that the motor shaft 14 rotates to angle θ. The control circuit 150 calculates the actual rotation number R of the motor shaft 14 according to the time difference between the adjacent edges of the rotation number signal. The actual rotation number R is utilized to generate the control signal.

Figure 7:
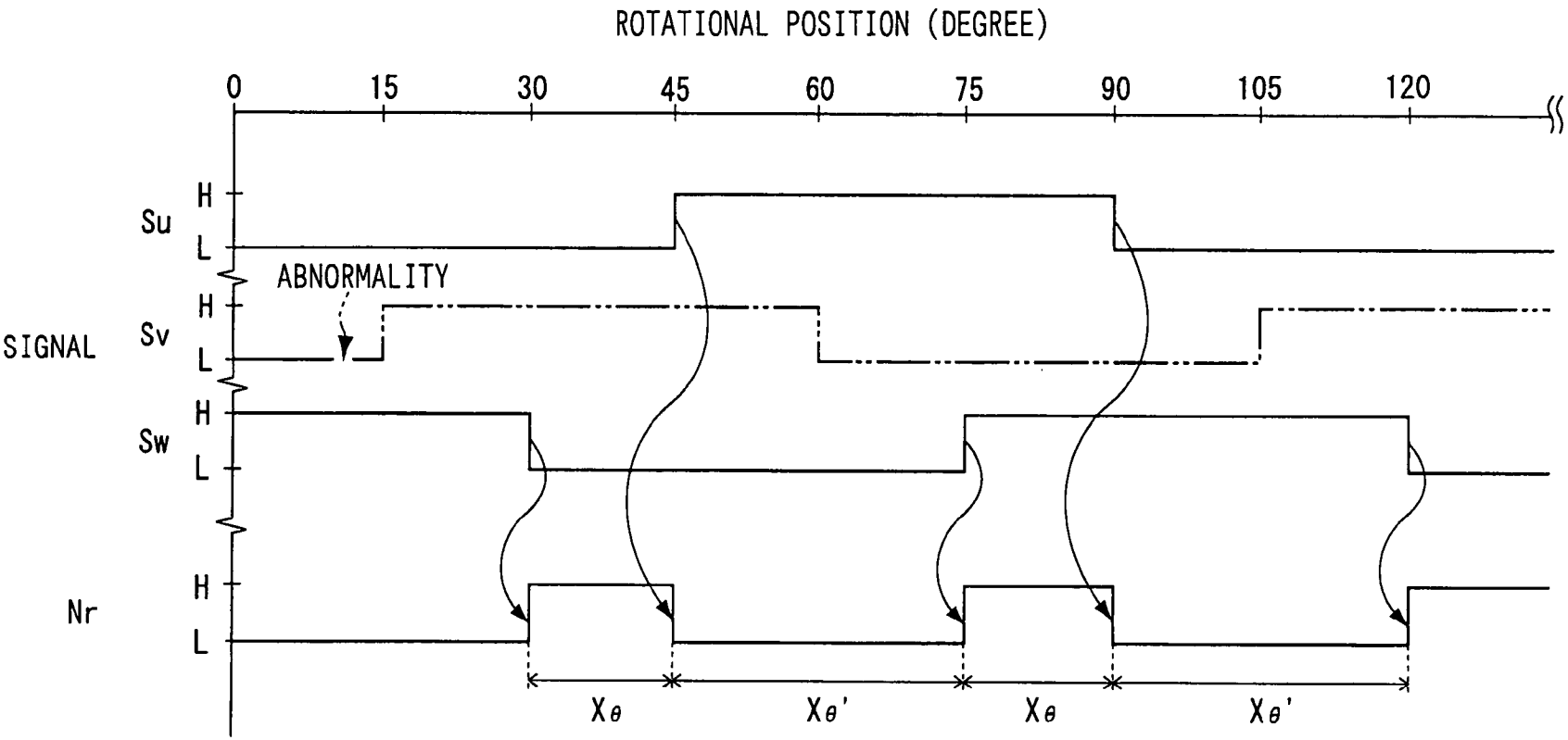
FIG. 7 is a time chart for explaining the operation of the motor control device according to the first embodiment.

When at least one of the Hall effect devices 18*u*, 18*v*, 18*w* does not operate normally and the detected signal is not transferred to the signal generating part 120. The defective signal, which is shown by a chain double-dashed line in FIG. 7, does not change the voltage of the rotation number signal Nr. Thus, the edge of the rotation number signal Nr is generated in a different timing from the normal timing. The angle range $X_\theta$ and the adjacent angle range $X_\theta'$ has different value, so that the motor shaft 14 rotates inconstant angle in the angle range $X_\theta$ and in the angle range $X_\theta'$. In such a situation, the control circuit 150 determines that the abnormality is arose in at least one of the Hall effect devices 18*u*, 18*v*, 18*w*, and send a command signal to the driving circuit 110 to stop the motor 12. The control circuit 150 compares the normal time difference of adjacent edges with the abnormal time difference of adjacent edges to determine the abnormality of the Hall effect devices 18*u*, 18*v*, 18*w*.

In the first embodiment described above, the signal generating part 120 generates the rotation number signal representing the actual rotation number R according to the detected signals by the Hall effect devices 18*u*, 18*v*, 18*w*, and sends the rotation number signal to the control circuit 150. Therefore, it is unnecessary to provide a specific sensor to detect the actual rotation number of the motor shaft 14 besides the Hall effect devices 18*u*, 18*v*, 18*w*, whereby the VTC 10 becomes compact and the production cost is reduced.

Furthermore, since the signal generating part 120 generates the rotation number signal Nr based on a plurality of detected signal by the Hall effect devices 18*u*, 18*v*, 18*w* which are disposed at different positions, the rotation number signal Nr precisely represents the actual rotation number R of the motor shaft 14. The control circuit 150 can calculates the actual rotation number R based on the edges of the rotation number signal Nr. Therefore, the control circuit 150 controls the motor 12 and the valve timing precisely.

Furthermore, the control circuit 150 can detects the abnormality of the Hall element 18*u*, 18*v*, 18*w* at an early stage. When the control circuit 150 detects the abnormality of the Hall effect devices 18*u*, 18*v*, 18*w*, the control circuit 150 sends the control signal to the driving circuit 110 in order to stop the motor 12. Thus, in the current supplying part 126 in which the switching elements 128 are turned on/off, the switching element which should be turned off is not mistakenly turned on. Therefore, the breakage of the motor 12 and the inverter circuit 127 due to over-current can be avoided.

(Second Embodiment)

Figure 8:
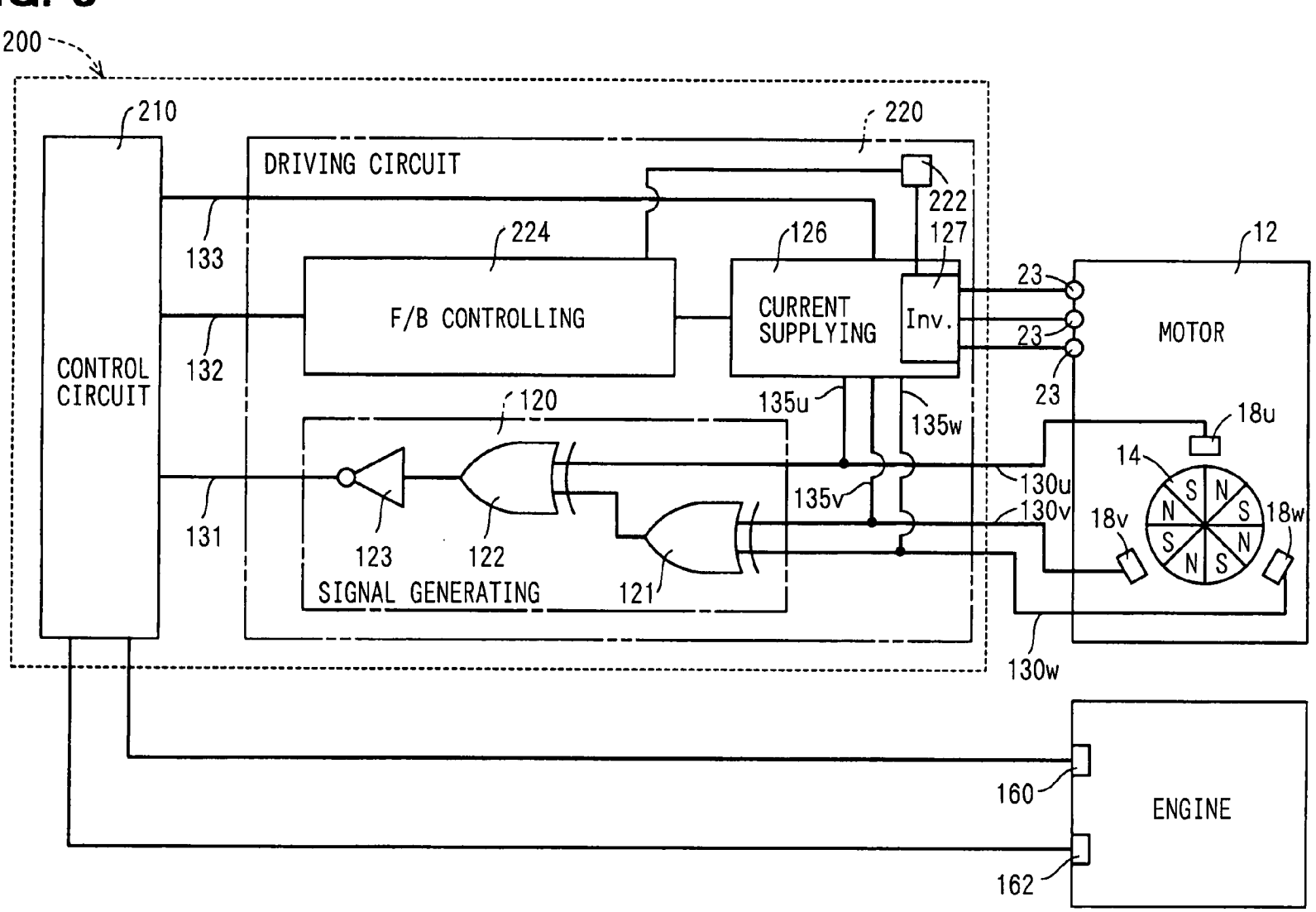
FIG. 8 is a block diagram showing a motor control device according to the second embodiment of the present invention.

FIG. 8 shows a motor control device 200 for the VTC according to the second embodiment in which the same parts and components as those in the first embodiment are indicated with the same reference numerals and the same descriptions will not be reiterated.

The control circuit 210 configures a target load current Ia of the motor 12 and the target rotation direction Da for maintaining or changing the rotational phase. The target load current Ia represents necessary load current to rotates the motor shaft 14 in the target rotation direction. The rotation number of the motor shaft 14 for changing or maintaining the rotation number is calculated based on the rotation number of the crank shaft and the cam shaft 11 and the actual rotation number R. The target load current Ia is calculated to establish the rotation number considering the rotation number of the crank shaft or the camshaft 11, oil temperature, and the voltage of power source. The control circuit 210 generates the first control signal and the second control signal, each of which corresponds to the target load current Ia and the target rotation direction respectively.

The driving circuit 220 of the motor control device 200 includes an ammeter 222 detecting an actual load current I of the motor 12 and a feedback controlling part 224, which determines voltage Vs applied to the motor 12 based on the first control signal representing the target load current Ia.

The ammeter 222 is connected with the inverter circuit 127 and generates a load current signal representing the detected actual load current I. The ammeter 222 can be provided in the motor 12 and can be connected to the wire 22.

The feedback controlling part 224 is connected with the control circuit 210 through the lead 132 in order to receive the first control signal and is connected to the current supplying part 126. The feedback controlling part 224 is not connected to the signal generating part 120 but to the ammeter 222 in order to receive a load current signal therefrom. The feedback controlling part 224 determines the applied voltage Vs in such a manner that the actual load current I represented by the load current signal coincides with the target load current Ia represented by the first control signal. The feedback controlling part 224 sends a command signal to the current supplying part 126 in order to generate the voltage Vs therein.

The second embodiment has the same effect as the first embodiment.

(Third Embodiment)

In the third embodiment, the present invention is applied to the valve lift controller 300. The valve lift controller 300 is referred to as VLC 300 hereinafter.

FIGS. 9 to 12 show essential parts of the VLC 300. The VLC 300 varies the maximum valve lift of an intake valve by utilizing rotational torque of a motor 320 which is controlled by a motor control device 370.

The VLC 300 includes an actuator 310 which linearly drives a control shaft 330 in an axial direction, and a valve lift mechanism (not shown) which changes the maximum valve lift of the intake valve according to the position of the control shaft 330.

Figure 9:
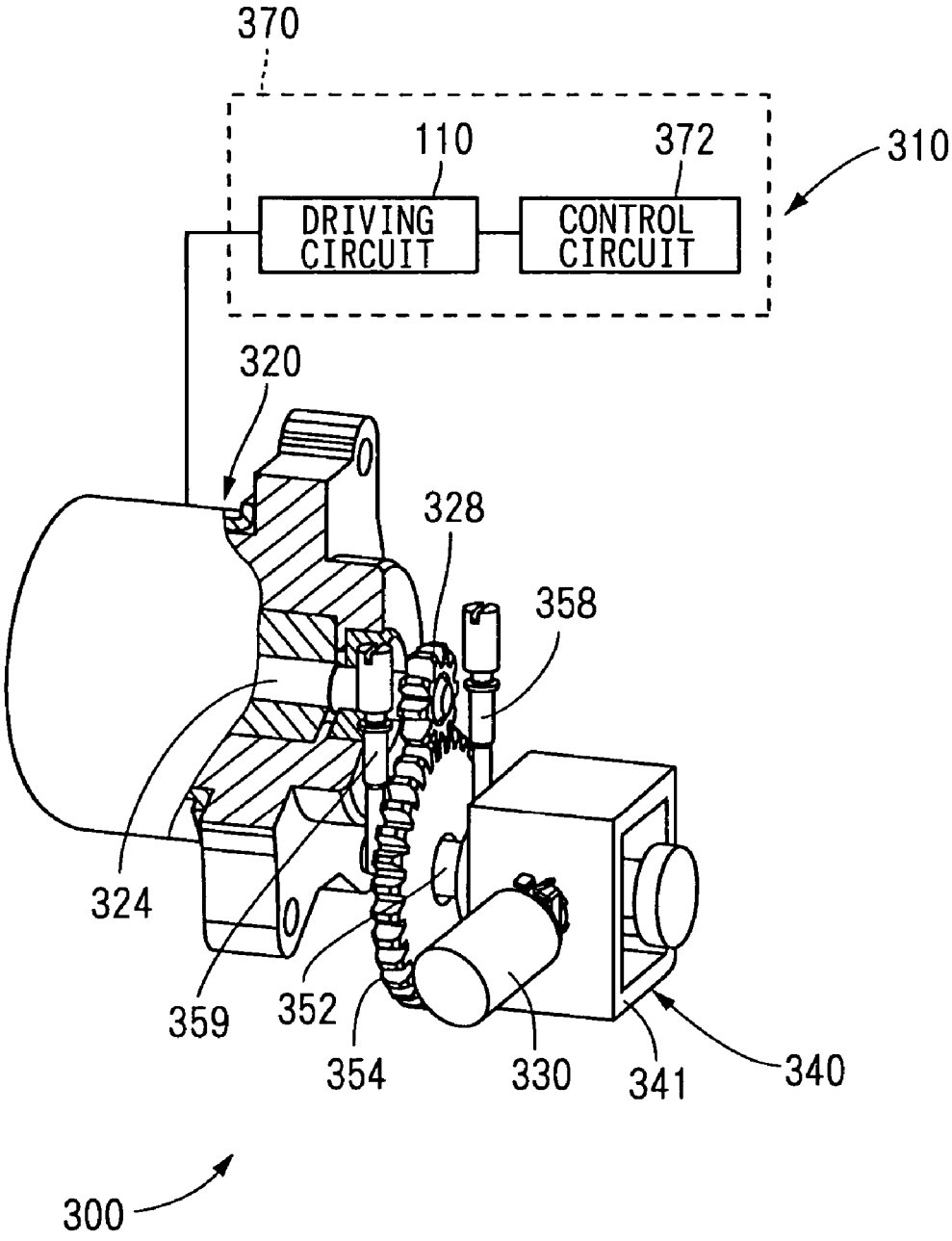
FIG. 9 is an oblique perspective and partially cross-sectional view of an essential part of a valve lift controller.

As shown in FIG. 9, the actuator 310 is provided with a motor 320, the control shaft 330, a transfer mechanism 340, a driving cam 350 (FIG. 11), and the motor control device 370. The motor 320 and the motor control device 370 are modifications of the motor 120 and the motor control device 370 in the first embodiment.

Figure 12:
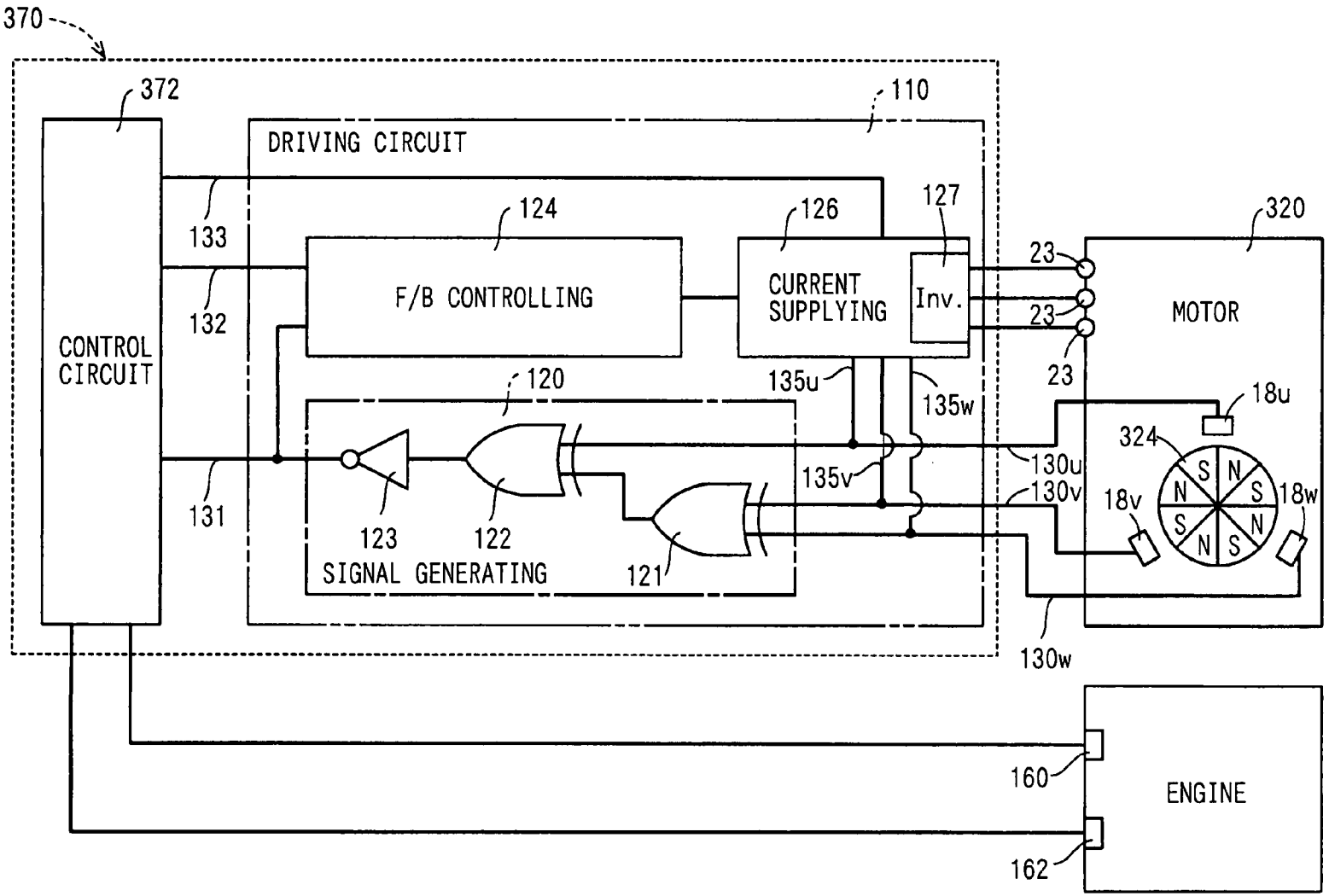
FIG. 12 is a block diagram showing a motor control device according to the third embodiment.

The motor 320 shown in FIGS. 9 and 12 is a three-phase brushless motor which has a motor shaft 324 connected with the motor gear 328 and a wire 322 connected with the driving circuit 110 of the motor control device 370. The motor 320 applies the rotational torque to the motor shaft 324 in the normal direction or reverse direction. The Hall effect devices 18*u*, 18*v*, 18*w* are provided in the motor 320, the Hall effect devices 18*u*, 18*v*, 18*w* generating the signals according to the rotational position θ of the motor shaft 324.

Figure 10:
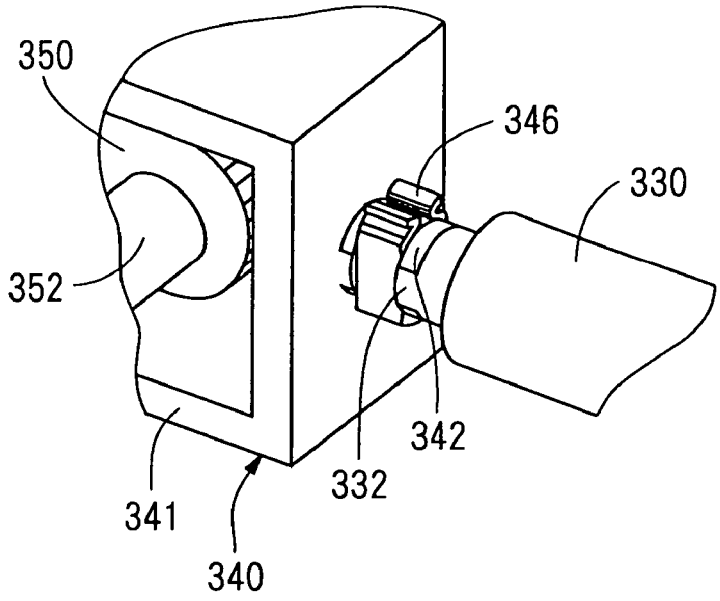
FIG. 10 is an oblique perspective view of an essential part of an actuator according to the third embodiment.
Figure 11:
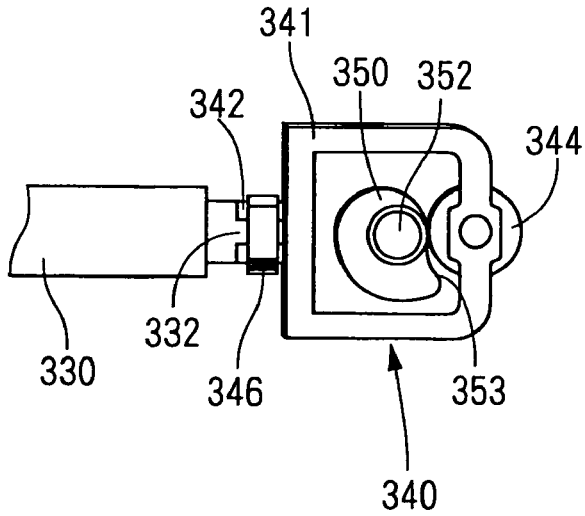
FIG. 11 is a side view of the essential part of the actuator according to the third embodiment.

The control shaft 330 is connected to a frame 341 of the transfer mechanism 340 at one end, and is connected to the valve lift mechanism. The control shaft 330 is orthogonal to the motor shaft 324 of the motor 320. As shown in FIGS. 10 and 11, the control shaft 330 has a connecting portion 332 which is engaged with a connecting portion 342 formed on the frame 341. Both of the connecting portions 332, 342 are bound together by a clip 346.

The transfer mechanism 340 includes a box-shaped frame 341 and a roller 344 which is supported by the frame 341 at the opposite side with respect to the control shaft 341.

A camshaft 352 of the driving cam 350 is disposed in the frame 341 to be parallel to the motor shaft 324. The driving cam 350 has a cam profile 353 which is slidablly in contact with the roller 344. The camshaft 352 has a cam gear 354 at the opposite end relative to the roller 344. The motor gear 328 and the cam gear 354 are engaged with each other to form a reduction gear.

A rotational angle range in which the can gear 354 can rotates is defined by a pair of protrusions (not shown) and stoppers 358, 359.

When the motor shaft 324 rotates, the rotational torque is transferred to the driving cam 350 through the motor gear 328 and the cam gear 354. When the driving cam 350 rotates while contacting with the roller 344, the control shaft 330 and the frame 341 which supports the roller 344 move back- and -forth in the axial direction of the control shaft 330. At this moment, the valve lift mechanism varies or adjusts the maximum valve lift according to the axial position of the control shaft 330, which moves along the cam profile 353.

As shown in FIG. 12, a control circuit 372 of the motor control device 370 configures the target rotation number Ra and the target rotation direction Da, and generates the first control signal corresponding to the target rotation number Ra and the second control signal corresponding to the target rotation direction Da. In order to determine the target rotation number Ra, the rotation number of the motor shaft 14 to maintain or change the rotational phase is derived based on the actual rotation number R of the motor shaft 14. The rotation numbers and the rotational signals of the crankshaft and the camshaft 11 represent the actual rotation number R. And then the derived rotation number is replaced by the target rotation number Ra.

In the motor control device 370 provided with the control circuit 372, the motor 320, the motor shaft 324 and the control circuit 372 operate as well as the motor 12, the motor shaft 14 and the control circuit 150 in the first embodiment.

In the third embodiment, it is unnecessary to provide a sensor for detecting the actual rotation number of the motor shaft 324 besides the Hall effect devices 18*u*, 18*v*, 18*w*. Thus, the VLC 300 becomes compact and the production cost is reduced.

Furthermore, since the signal generating part 390 generates the rotation number signal Nr based on a plurality of detected signal by the Hall effect devices 18*u*, 18*v*, 18*w* which are disposed at different positions, the rotation number signal Nr precisely represents the actual rotation number R of the motor shaft 324. The control circuit 372 can calculates the actual rotation number R based on the edges of the rotation number signal Nr. Therefore, the control circuit 372 precisely controls the motor 320 and the valve lift.

Furthermore, the control circuit 372 can detect the abnormality of the Hall element 18*u*, 18*v*, 18*w* at an early stage. When the control circuit 372 detects the abnormality of the Hall effect devices 18*u*, 18*v*, 18*w*, the control circuit 372 sends the control signal to the driving circuit 110 in order to stop the motor 320. Thus, in the current supplying part 126 in which the switching elements 128 are turned on/off, the switching element which should be turned off is not mistakenly turned on. Therefore, the breakage of the motor 320 and the inverter circuit 127 due to over-current can be avoided.

(Fourth Embodiment)

Figure 13:
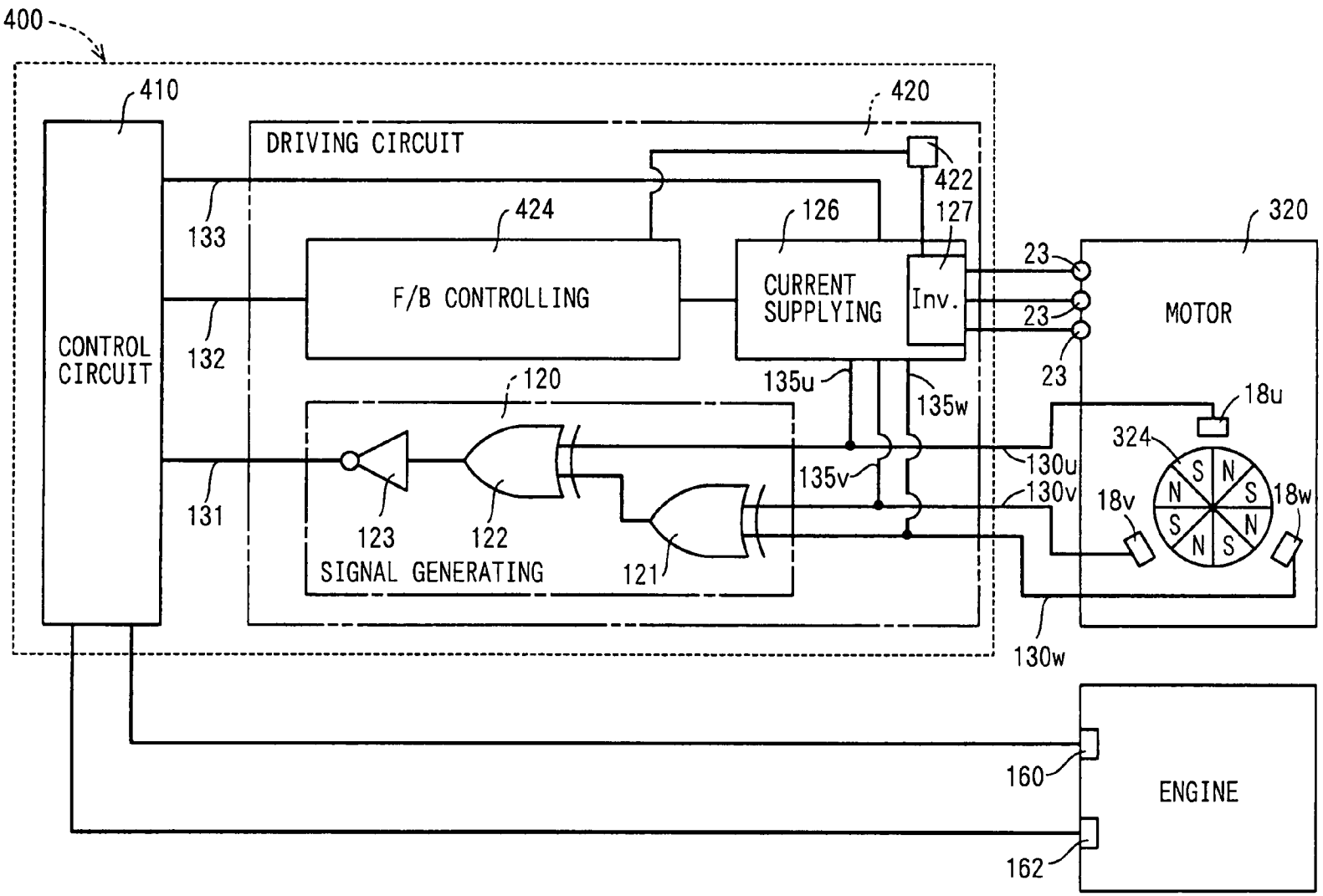
FIG. 13 is a block diagram showing a motor control device according to a fourth embodiment.

FIG. 13 shows a motor control device 200 for the VTC according to the fourth embodiment in which the same parts and components as those in the first embodiment are indicated with the same reference numerals and the same descriptions will not be reiterated.

The control circuit 410 configures a target load current Ia of the motor 320 and the target rotation direction Da for maintaining or changing the valve lift. The target load current Ia represents necessary load current to rotates the motor shaft 324 in the target rotation direction. The rotation number of the motor shaft 324 for changing or maintaining the valve lift is calculated based on the rotation number of the crank shaft and the cam shaft and the actual rotation number R of the motor shaft 324. The target load current Ia is calculated to establish the rotation number considering the rotation number of the crankshaft or the camshaft, oil temperature, and the voltage of power source. The control circuit 410 generates the first control signal and the second control signal, each of which corresponds to the target load current Ia and the target rotation direction respectively.

The control circuit 420 includes an ammeter 422 which is connected to the inverter circuit 127 and which generates a load current signal by detecting an actual load current I of the motor 320. The ammeter 420 can be disposed in the motor 320 and be connected to the wire 322.

The feedback control part 424 of the driving circuit 420 is not connected to the signal generating part 120 but to the ammeter 422 in order to receive the load current signal. The feedback control part 424 determines a applied voltage Vs as a control value which coincide the load current I represented by the load current signal with the target load current Ia represented by the first control signal.

The fourth embodiment has the same effect as the third embodiment described above.

In all the embodiments described above, the signals detected by the Hall effect devices 18*u*, 18*v*, 18*w* can be transferred to the control circuit 150, 210, 372, 410 in order that the control circuit 150, 210, 372, 410 functions as well as the signal generating part 120.

The actual rotation number R of the motor shaft 14, 324 can represent the rotational direction. The rotational direction can be derived from an order of the edges in the signals detected by the Hall effect devices 18*u*, 18*v*, 18*w*.

In the first and the second embodiments, the first control signal can be generated only based on the signal detected by the rotation sensor 160, 162.

In the first to the fourth embodiments, magnetoresistive effect elements can be used as rotational position sensors instead of the Hall effect devices.

In the first to the forth embodiments, magnetoresistive effect elements can be used as rotational position sensors instead of the Hall effect devices In the third and the fourth embodiments, the VLC can adjust the valve lift of the intake valve and/or the exhaust valve.

What is claimed is:

1. An apparatus comprising:

a valve controller for adjusting a valve characteristic of an internal combustion engine utilizing rotational torque of a motor, the valve controller comprising:

a control circuit generating a control signal;

a plurality of rotational position sensors detecting rotational position of the motor and generating respective rotational position signals; and a driving circuit for driving the motor based on the control signal and the rotational position signals, the driving circuit generating a rotation number signal which represents actual rotation of the motor based on the rotational position signals, the driving circuit transmitting the rotation number signal to the control circuit;

wherein the driving circuit receives the rotational position signals which have a voltage that is varied according to rotational position of the motor, and wherein the driving circuit changes voltage of the rotation number signal between high voltage and low voltage at the time of every edge of the rotational position signals.

2. The valve controller according to claim 1, wherein the rotational position sensors comprise Hall effect devices.

3. The valve controller according to claim 1, wherein the control circuit determines that at least one of the rotational position sensors has abnormality when the edges of the rotational position signals are generated in a period which is different from a predetermined period.

4. The valve controller according to claim 1, wherein the control circuit generates the control signal based on the rotation number signal.

5. The valve controller according to claim 1, wherein the control circuit controls an operation of an engine.

6. The valve controller according to claim 1, wherein the valve controller adjusts valve timing which is one valve characteristic.

7. The valve controller according to claim 1, wherein the valve controller adjusts maximum valve lift which is one valve characteristic.

8. An apparatus comprising:

a valve controller for adjusting a valve characteristic of an internal combustion engine utilizing rotational torque of a motor, the valve controller comprising:

a control circuit generating a control signal;

a plurality of rotational position sensors detecting rotational position of the motor and generating rotational position signals having a voltage that sequentially transitions in voltage level according to rotational position of the motor; and a driving circuit for driving the motor based on the control signal and the rotational position signals from each of the rotational position sensors, the driving circuit compositing the rotational position signals to generate a rotation number signal which represents an actual rotation number of the motor, the driving circuit transmitting the rotation number signal to the control circuit.

9. A method comprising:

adjusting a valve characteristic of an internal combustion engine utilizing rotational torque of a motor, including:

detecting rotational position of the motor using plural position sensors generating respectively corresponding plural rotational position signals; and driving said motor based on said plural rotational position signals and a motor rotation number signal derived therefrom, the rotational position signals having a voltage that transitions according to rotational position of the motor, and the derived motor rotation number signal changes its voltage level at the time of each transition of the rotational position signals.

10. A method as in claim 9 including use of Hall effect devices, for said position sensors.

11. A method as in claim 9 further comprising:

determining that at least one of the rotational position sensors has an abnormality when edges of the rotational position signals are generated in a period which is different from a predetermined period.

12. A method as in claim 9 wherein a control circuit generates a motor control signal based on the rotation number signal.

13. A method as in claim 12 wherein said control circuit controls an operation of an engine.

14. A method as in claim 9 wherein valve timing is adjusted by said motor.

15. A method as in claim 9 wherein maximum valve lift is adjusted by said motor.

16. A method comprising:

adjusting a valve characteristic of an internal combustion engine utilizing rotational torque of a motor, including:

generating a control signal;

detecting rotational position of the motor with a plurality of rotational position sensors and generating corresponding rotational position signals having a voltage that sequentially transitions in voltage level according to rotational position of the motor; and driving the motor based on the control signal and the rotational position signals from each of the rotational position sensors by compositing the rotational position signals to generate a rotation number signal which represents an actual rotation number of the motor and using the rotation number signal to generate the control signal.

* * * * *